US006513247B1

(12) United States Patent
Krasik-Geiger et al.

(10) Patent No.: US 6,513,247 B1
(45) Date of Patent: Feb. 4, 2003

(54) CALIBRATED ANGLE AND DEPTH SCISSORS

(76) Inventors: Ariel Krasik-Geiger, 1849 N. 53rd St., Seattle, WA (US) 98103; Michael Krasik, 1849 N. 53rd St., Seattle, WA (US) 98103

( * ) Notice: Subject to any disclaimer, the term of this patent is extended or adjusted under 35 U.S.C. 154(b) by 361 days.

(21) Appl. No.: 09/072,911

(22) Filed: May 4, 1998

Related U.S. Application Data

(60) Provisional application No. 60/047,910, filed on May 29, 1997.

(51) Int. Cl.[7] ..... B26B 13/22
(52) U.S. Cl. ..... 30/233; 30/293
(58) Field of Search ..... 30/233, 293, 179, 30/178, 177, 229, 197; 33/424, 425, 426

(56) References Cited

U.S. PATENT DOCUMENTS 598,031 A * 1/1898 Steen ..... 30/233 X
736,042 A * 8/1903 Waters ..... 33/426 X
1,856,779 A * 5/1932 Montelius ..... 33/426 X
1,935,812 A 11/1933 Moody
3,178,817 A * 4/1965 Rubinstein ..... 30/293
3,416,232 A * 12/1968 Overbay ..... 33/424
3,840,989 A 10/1974 Hexdall ..... 30/233 X
3,885,306 A 5/1975 Herman ..... 30/123
4,106,195 A * 8/1978 Berg ..... 30/179 X
4,428,124 A 1/1984 Asakura ..... 30/233 X
4,776,096 A 10/1988 Chang ..... 30/233
4,783,867 A 11/1988 Tsao ..... 30/123 X
4,901,440 A * 2/1990 Go et al. ..... 30/233 X
5,035,054 A * 7/1991 Ellenberger ..... 30/233
5,205,045 A * 4/1993 Liu ..... 33/426 X
5,542,182 A * 8/1996 Martinez ..... 30/179

FOREIGN PATENT DOCUMENTS

FR 969731 * 5/1950 ..... 30/233
GB 9594 * 6/1902 ..... 30/233

* cited by examiner

*Primary Examiner*—Charles Goodman
(74) *Attorney, Agent, or Firm*—Seed I.P. Law Group, PLLC

(57) ABSTRACT

A scissors with built-in ruler and protractor allows precision cuts to measured lengths and angles without the use of separate external measuring tools and marking devices.

3 Claims, 1 Drawing Sheet

CALIBRATED ANGLE AND DEPTH SCISSORS

CROSS REFERENCE TO RELATED APPLICATIONS

This non-provisional application claims priority from copending, corresponding provisional application Ser. No. 60/047,910, filed May 29, 1997.

BACKGROUND OF THE PRIOR ART

Ordinary scissors are effective for cutting material like paper or cloth but when one wishes to make a precision cut, to a certain measured depth or at a certain measured angle, other separate tools such as a ruler and protractor must be employed, along with the need to make guide marks on the material to be cut with a marking device such as a pencil.

The object of this invention is to allow a method for precision scissors cutting without the need to use other separate tools such as a ruler, protractor, and pencil. Furthermore, the object of this invention is create an improved scissors with built-in ruler and protractor functions thereby eliminating the need for a separate marking device as is commonly used with an ordinary ruler or protractor.

SUMMARY OF THE INVENTION

This tool is an improved scissors which has both a ruler and a movable protractor mounted S on one of the blades of the scissors. To make a cut of a certain depth, for example 1 inch, you put the edge of the paper on top of the ruler gauge at the 1 inch mark; then you make the cut. To make a cut of a certain acute or obtuse angle, you rotate the paper you are about to cut so that the edge of the paper matches the angle line on the protractor, then you make the cut. You could also hold the edge of the paper parallel to the angle line on the protractor and then make the cut. If you want to make a cut of a certain angle that is also a specific depth of cut, you first slide the 90 degree line on the protractor to the desired depth mark on the ruler gauge. Then you slide the edge of the paper to that same depth mark and rotate the paper so that the edge of the paper matches the desired angle line on the protractor; then you make the cut.

This invention eliminates the need to use a separate marking device (pen or pencil) which is needed when using an ordinary ruler and protractor with a conventional scissors. For cutting out geometric shapes on paper, this invention saves a lot of time when compared to the conventional use of separate rulers, protractors, marking devices, and scissors.

Use of this invention can involve a method of cutting wherein the paper being cut is inverted on some cuts, depending upon the direction of the cut, so as to allow the operator to always have a conventional view of the cut with the paper covering the top portion of the protractor. Other embodiments of this invention are anticipated including having similar mensuration devices attached to both blades of the scissors. This would eliminate the need to invert the paper for some cuts in certain directions.

BEST MODE FOR CARRYING OUT THE INVENTION

Figure 1:
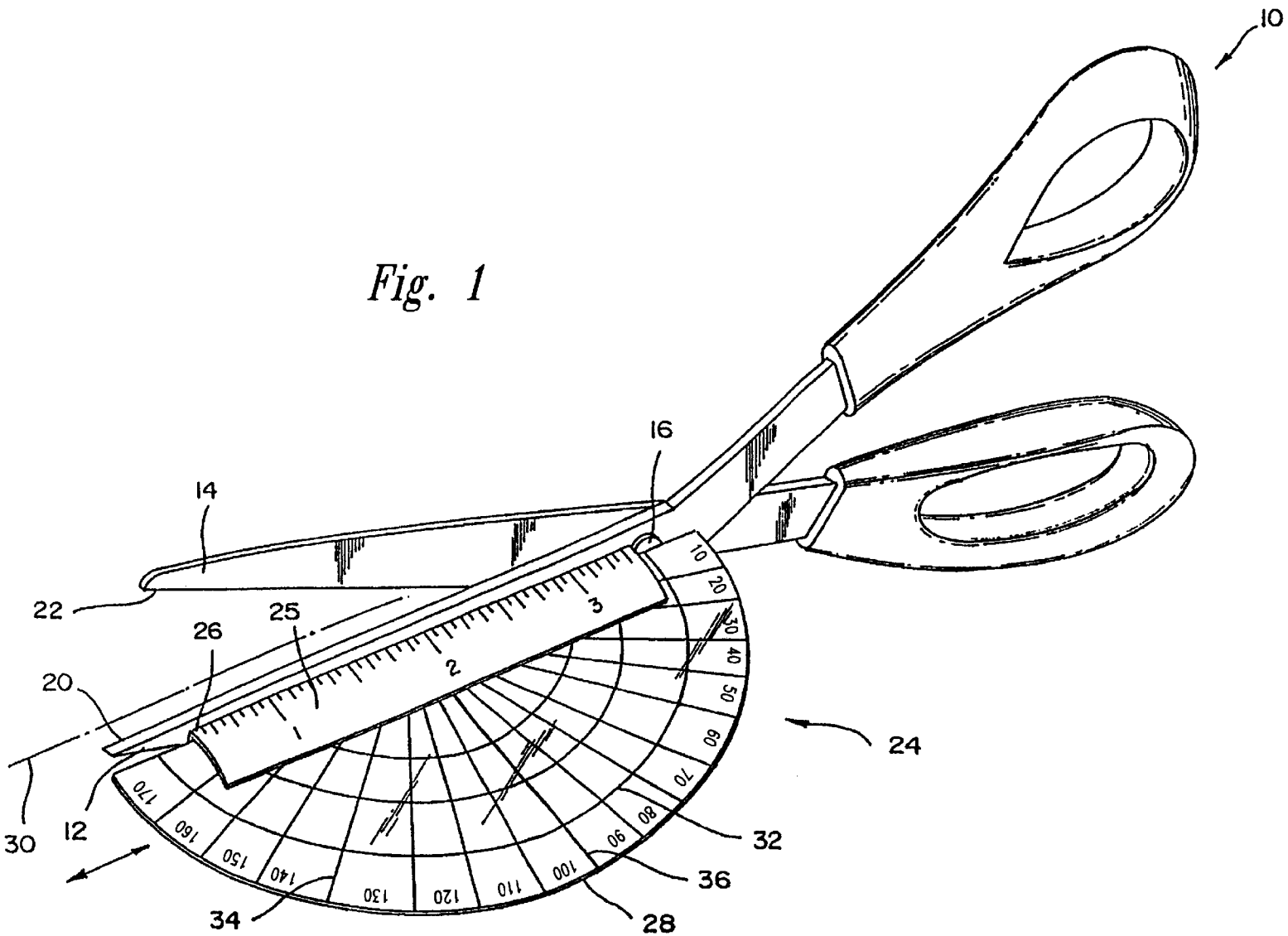
FIG. 1 is a perspective view of the present invention.

This tool is a scissors (10) comprised of a first part (12) and a second part (14) connected by a pivot (16), first and second parts each having blade portions (20 and 22). Mounted to the first part (12) is a mensuration device generally indicated by reference numeral 24. The mensuration device (24) has a base member (26) which is attached to the first part (12) at a position between the pivot (16) and the forward tip of the first blade portion (20) mounted substantially parallel to the cutting edge of the first blade portion (20). The base member (26) has a linear scale or ruler (25) for distance measurement from the coincidental forward ends of the blade portions (20 and 22) and a protractor (28) for angle measurement relative to the long axis of the blade portions (20 and 22). The protractor (28) must be crafted such that the imaginary center point of the protractor will be coincident with the cutting edges of the blade portions (20 and 22).

The base member (26) has the means to support the protractor (28) in place substantially perpendicular to the external face of the first part (12) and on a plane substantially parallel to the plane of the paper (30) being cut. The base member (26) has the means to allow the protractor (28) to be manually repositioned along the long axis of the base member (26).

A piece of paper (30) can be inserted between the blade portions (20 and 22) and an edge of the paper can be aligned with a certain reading on the ruler (25) then cut to a length equal to the reading on the ruler (25).

A multitude of radial lines (34) on the protractor (28) at designated angles allow an edge of the paper (30) to be aligned coincident with a designated radial line to affect an angular cut on the paper (30) at that designated angle. If the ninety degree radial line (36) is positioned to match a certain reading on the ruler (25) the resulting length of the cut at the designated angle will equal the reading on the ruler (25).

If the edge of the paper (30) is aligned parallel to but not coincident with a certain radial line (34) the resulting cut will be at an angle equal to the angle of that certain radial line but with an uncalibrated length of cut. Concentric circular lines (32) are marked on the protractor (28) at various radii for the purpose of cutting at a known measured distance from an edge of the paper (30).

The base (26) can be mounted to the first part (12) in a variety of ways including permanent affixing or temporary affixing with magnets or other non-permanent means. Temporary affixing allows retrofitability to many existing conventional scissors. Other methods of affixing for the base (26) are anticipated including a base (26) which is a fully integrated non-separate part of first part (12) of the scissors (10).

The improved scissors (10) can be used in a method of teaching various skills to students wherein the instructor will write or verbally call out cutting instructions and students who follow the instructions properly will properly cut out a predetermined shape.

The improved scissors (10) can be used in a method of teaching various skills to students by requiring students to cut out predetermined shapes with certain dimensions without using separate measuring tools or marking devices.

We claim:

1. A device for cutting sheet material to a desired depth and angle, comprising:

a scissors having a rearwardly positioned handle and, forwardly positioned first and second blades defining a cutting plane and being pivotally connected together about a pivot point for arcuate movement; and, a planar angle mensuration device connected to the first blade substantially perpendicular to the cutting plane so as to be substantially parallel to the sheet material to be cut, the angle mensuration device having a plurality of visible radial indications thereon having an origin positioned forwardly of the pivot point.

2. The device of claim 1, wherein the first blade has visible linear mensuration markings thereon for determining the depth of a desired cut in the sheet material.

3. The device of claim 1, wherein the first blade has visible linear mensuration markings thereon for determining the depth of a desired cut in the sheet material.

* * * * *